US009053836B2

(12) United States Patent
Yagi

(10) Patent No.: US 9,053,836 B2
(45) Date of Patent: Jun. 9, 2015

(54) SHIELDED ELECTRIC WIRE

(71) Applicant: YAZAKI CORPORATION, Tokyo (JP)

(72) Inventor: Daisuke Yagi, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 243 days.

(21) Appl. No.: 13/666,598

(22) Filed: Nov. 1, 2012

(65) Prior Publication Data

US 2013/0105194 A1 May 2, 2013

(30) Foreign Application Priority Data

Nov. 2, 2011 (JP) ..... 2011-241336

(51) Int. Cl.
*H01B 7/18* (2006.01)
*H01B 7/08* (2006.01)

(52) U.S. Cl.
CPC ..... *H01B 7/0861* (2013.01); *H01B 7/0823* (2013.01)

(58) Field of Classification Search
CPC ..... H01B 3/00; H01B 3/301; H01B 3/308; H01B 3/3421; H01B 3/421; H01B 3/44; H01B 3/443; H01B 7/00; H01B 7/009; H01B 7/0018; H01B 7/02; H01B 7/0208; H01B 7/0216; H01B 7/0266
USPC ..... 174/102 R, 103, 106 R, 108, 109, 110 R, 174/113 R, 117 R, 117 F
See application file for complete search history.

(56) References Cited

U.S. PATENT DOCUMENTS

| | | | | | |
|---|---|---|---|---|---|
| 3,634,782 | A | * | 1/1972 | Marshall | 333/1 |
| 4,404,424 | A | * | 9/1983 | King et al. | 174/34 |
| 4,475,006 | A | * | 10/1984 | Olyphant, Jr. | 174/36 |
| 4,973,794 | A | * | 11/1990 | Steele | 174/36 |
| 5,112,419 | A | * | 5/1992 | Nakagawa | 156/51 |
| 5,268,531 | A | * | 12/1993 | Nguyen et al. | 174/36 |
| 5,360,944 | A | * | 11/1994 | Springer et al. | 174/117 F |
| 5,504,274 | A | * | 4/1996 | McCabe et al. | 174/36 |
| 5,552,565 | A | * | 9/1996 | Cartier et al. | 174/117 F |
| 5,554,825 | A | * | 9/1996 | Parker et al. | 174/117 F |
| 5,900,588 | A | * | 5/1999 | Springer et al. | 174/117 F |

(Continued)

FOREIGN PATENT DOCUMENTS

| | | | |
|---|---|---|---|
| CN | 102044315 | A | 5/2011 |
| CN | 102054544 | A | 5/2011 |
| JP | 2010244838 | A | 10/2010 |

OTHER PUBLICATIONS

Chinese Office Action issued on Dec. 19, 2014 by The State Intellectual Property Office of the PR of China in related application No. 201210433370.5.

*Primary Examiner* — William H Mayo, III
(74) *Attorney, Agent, or Firm* — Sughrue Mion, PLLC

(57) ABSTRACT

A shielded electric wire that assumes a horizontally long cross sectional wire profile and includes a flat shielded electric wire that has a plurality of sheathed core wires whose core centers are positioned side by side at grade. The shielded electric wire has an electromagnetic shield layer that encloses all of the positioned sheathed core wires, and a pair of additional electromagnetic shield layers laid solely along a pair of mutually-opposed long sides in line with a direction in which the sheathed core wires are arranged in a wire cross section.

2 Claims, 3 Drawing Sheets

(56) References Cited

U.S. PATENT DOCUMENTS 6,870,105 B2 * 3/2005 Maydanich et al. ..... 174/72 TR
2002/0062980 A1 * 5/2002 Nuyten et al. ..... 174/117 F
2011/0083877 A1 4/2011 Sugiyama et al.
2011/0100682 A1 5/2011 Nonen et al.

* cited by examiner

SHIELDED ELECTRIC WIRE

BACKGROUND OF THE INVENTION

The present invention relates to a shielded electric wire that assumes a horizontally long, flat cross sectional wire profile, such as an elliptical (including an ellipsoidal) cross sectional profile and a rectangular cross sectional profile.

A shielded electric wire that collectively provides electromagnetic shielding to a multicore electric wire has hitherto been heavily used at the time of transmission of a plurality of signals, like transmission of a video signal and transmission of a motor drive signal. For instance, a cable used for driving a three-phase motor transmits high voltage electric power and high current electric power. Therefore, in consideration of electromagnetic interference with an environment, the cable is embodied as a three-core shielded electric wire with heavy electromagnetic shielding (an electromagnetic shielding structure exhibiting high shielding performance). In a three-phase motor, three connector terminals are often arranged in line. For this reason, a shielded electric wire used as a cable also assumes a cross sectional profile including three cores horizontally arranged in line in conformity with a terminal layout or a cross sectional profile of the connector (see; for instance, Patent Document 1).

CITATION LIST

Patent Document 1: Japanese Patent Publication No. JP-A-2010-244838

Incidentally, a shielded electric wire in which an electromagnetic shield layer assumes a non-circular cross sectional profile is usually inferior in shielding characteristic to an electric wire whose electromagnetic shield layer assumes a circular cross sectional profile. An electric wire in which all core wires making up the electric wire are not equidistant from a center position of the electric wire is inferior in shielding characteristic to a shielded electric wire in which all of the core wires are equidistant from the center position. The reason for this is that a distribution of density of electric currents flowing through the core wires and a shield layer becomes nonuniform, a high-current-density region is susceptible to leakage of an electromagnetic field.

As shown in FIG. 3A, a flat shielded electric wire 501 that includes three sheathed core wires 507 and that assumes a horizontally-long flat cross sectional wire profile is inferior in shielding characteristic to a shielded electric wire assuming a circular cross sectional profile. For these reasons, as illustrated, a contrivance has been made to prevent deterioration of the shielding characteristic by changing the electromagnetic shield structure, such as an increase in the number of electromagnetic shield layers 503. Moreover, like a shielded electric wire 505 shown in FIG. 3B, there is adopted a method for arranging the three sheathed core wires 507 in a triangular layout to assume a circular cross sectional profile.

An increase in the number of electromagnetic shield layers 503 enables prevention of deterioration of the shielding characteristic of the flat shielded electric wire 501 assuming a horizontally long cross sectional wire profile. However, it also raises a problem of an increase in the mass and material costs of the electromagnetic shielding structure.

Furthermore, the shielded electric wire 505 including three core wires arranged in a triangular layout can prevent an increase in material cost when compared with the case where the number of electromagnetic shield layers 503 is increased. However, a wire diameter D becomes greater when compared with a thickness T of the flat shielded electric wire 501.

Hence, the shielded electric wire is subjected to a problem of routing of an electric wire being limited depending on an objective structure in which the electric wire is to be mounted, such as a vehicle.

SUMMARY

The invention has been conceived in light of the circumstance and aims at providing a shielded electric wire that prevents deterioration of a shielding characteristic while preventing an increase in mass and material cost even when the electric wire assumes a horizontally long cross sectional wire profile.

The object of the invention is accomplished by the configuration provided below.

(1) A shielded electric wire having a plurality of sheathed core wires whose core centers are positioned side by side at grade, the shielded electric wire comprising:

an electromagnetic shield layer enclosing all of the positioned sheathed core wires and a pair of additional electromagnetic shield layers laid solely along a pair of mutually-opposed long sides in line with a direction in which the sheathed core wires are arranged in a wire cross section.

In the shielded electric wire having Configuration (1), only each of regions of high current density which would deteriorate a shielding characteristic; namely, each of the long sides laid in line with a direction in which the sheathed core wires are arranged in the wire cross section, is provided with the additional electromagnetic shield layer. Deterioration of a shielding characteristic can thereby be prevented with reduction of cost and mass.

(2) A shielded electric wire having a plurality of sheathed core wires whose core centers are positioned side by side at grade, wherein an electromagnetic shield layer enclosing all of the positioned sheathed core wires includes a pair of high density braided shields provided along a pair of mutually-opposed long sides in line with a direction in which the sheathed core wires are arranged in a wire cross section and a pair of low density braided shields for connecting together both side ends of the high density braided shields.

In the shielded electric wire having Configuration (2), each of regions of high current density which would deteriorate a shielding characteristic; namely, each of the long sides laid in line with a direction in which the sheathed core wires are arranged in the wire cross section, is provided with the high density braided shield, and each of other sides are provided with the low density braided shield. Deterioration of a shielding characteristic can thereby be prevented with reduction of cost and mass.

The shielded electric wire of the invention prevents deterioration of a shielding characteristic despite its horizontally long cross sectional wire profile with reduction of material costs and mass.

Thus far the invention has been briefly described. Details of the invention will further become much clearer by reading through modes (hereinafter referred to as "embodiments") for implementing the invention, which will be described below, by reference with the accompanying drawings.

DETAILED DESCRIPTION OF EMBODIMENTS

Embodiments of the invention are hereunder described by reference to the drawings.

Figure 1:
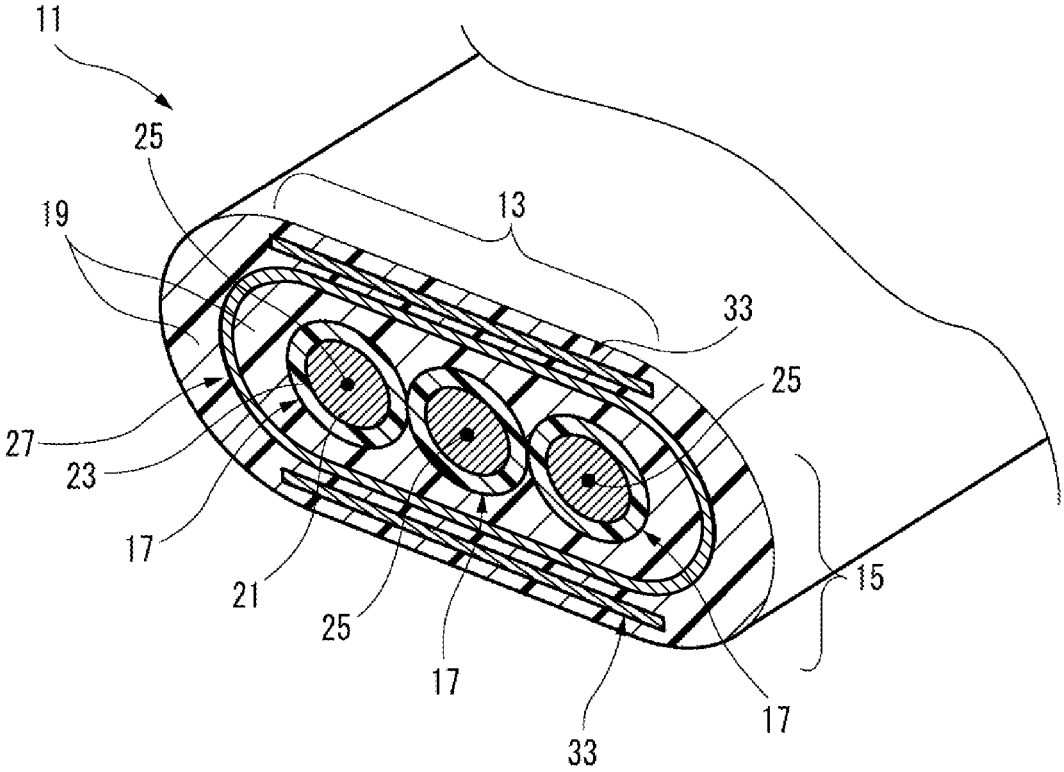
FIG. 1 is a transverse cross sectional view of a shielded electric wire of a first embodiment of the invention.

As shown in FIG. 1, a flat shielded electric wire 11 of a first embodiment of the invention is a shielded electric wire including a plurality of sheathed core wires 17 whose core centers 25 are arranged side by side at grade. The flat shielded electric wire 11 has an electromagnetic shielding structure made up of a pair of mutually-opposed long sides 13 positioned in line with a direction in which the sheathed core wires 17 are arranged in the wire cross section and another different electromagnetic shielding structure made up of a pair of mutually-opposed short sides 15. The long sides 13 are configured so as to exhibit a higher shielding effect than that yielded by the short sides 15.

Specifically, the flat shielded electric wire 11 of the embodiment has the sheathed core wires 17; an insulating layer 19, an electromagnetic shield layer 27 enclosing all of the sheathed core wires 17 arranged side by side; and a pair of additional electromagnetic shield layers 33 that are laid along only the pair of mutually-opposed long sides 13 in line with the direction in which the sheathed core wires 17 are arranged in a wire cross section. The cross section of the electric wire used in the specification refers to a cross section in a direction orthogonal to an axial line of the electric wire.

In each of the sheathed core wires 17, a linear conductor 21 is covered with an insulating sheath 23. A fluoro resin, polyethylene, or foamed polyethylene, for instance, can be used for the insulating sheath 23. The conductor 21 may be either a round single wire having a circular cross sectional profile, such as that illustrated, or a flat single wire having a rectangular cross sectional profile. Further, the conductor 21 may also be a stranded wire composed of a plurality of stranded element wires. In the embodiment, the number of the sheathed core wires 17 are three. In addition, the number of the sheathed core wires 17 may also be two or more than three. The core centers 25 of the three sheathed core wires 17 are arranged and positioned side by side at grade. The flat shielded electric wire 11 assumes a horizontally long flat cross sectional wire profile.

The insulating layer 19 is formed from an insulating resin; for instance, a fluoro resin, polyethylene, or foamed polyethylene, and covers the three sheathed core wires 17, to thus assume an elliptical cross sectional profile. In addition to the illustrated elliptical cross sectional profile, the flat shielded electric wire 11 may also assume an ellipsoidal cross sectional profile, a rectangular cross sectional profile, or the like, so long as the flat shielded electric wire 11 assumes a flat cross sectional wire profile. Accordingly, the flat shielded electric wire 11 has the long sides 13 along the direction in which the sheathed core wires 17 are arranged and the short sides 15 along a direction orthogonal to the direction.

The sheathed core wires 17 are enclosed by an electromagnetic shield layer 27 through the insulating layer 19. Metallic foil or a metal braid can be used for the electromagnetic shield layer 27. The embodiment provides an explanation by taking, for example, the electromagnetic shield layer 27 formed from metallic foil. For instance, aluminum foil, copper foil, or the like, can be used as the metallic foil. The metallic foil encloses all of the positioned sheathed core wires 17, assuming an elliptical cross sectional profile.

The strip-shaped additional electromagnetic shield layers 33 that are stretched along the axial line of the electric wire are laid along the respective long sides 13 outside the electromagnetic shield layer 27. Metallic foil or a metal braid can be used for the additional electromagnetic shield layers 33 as with the electromagnetic shield layer 27. The embodiment provides an explanation by taking, as example, the additional electromagnetic shield layers 33 that are also formed from metallic foil.

The insulating layer 19 may or may not lie between the electromagnetic shield layer 27 and the additional electromagnetic shield layers 33. When the insulating layer 19 lies, there is formed a two-layer structure in which the electromagnetic shield layer 27 and the additional electromagnetic shield layers 33 do not contact each other. Further, when the insulating layer 19 does not lie, there is formed a double structure in which the electromagnetic shield layer 27 and the additional electromagnetic shield layers 33 contact each other.

The flat shielded electric wire 11 of the embodiment has a two-layer structure in which the electromagnetic shield layer 27 and the additional electromagnetic shield layers 33 lie only along the long sides 13.

Function of the flat shielded electric wire 11 having the foregoing structure is now described.

The flat shielded electric wire 11 has a shield that is means for hindering noise which would otherwise travel between the air and the conductors 21. The shield is made up of the electromagnetic shield layer 27 and the additional electromagnetic shield layers 33. Noise that travels through the air includes electrostatic induction, electromagnetic induction, and an electric wave (an electromagnetic wave). A shield that hinders electrostatic induction is an electrostatic shield; a shield that hinders electromagnetic induction is a magnetic shield; and a shield that shields an electromagnetic wave is an electromagnetic shield. The flat shielded electric wire 11 has an electromagnetic shielding function.

An electric field in an electromagnetic wave corresponds to a voltage of electricity, and a magnetic field corresponds to an electric current of electricity. An impedance exists between a voltage and an electric current, and a characteristic impedance exits between a voltage and a current in a transmission line. Likewise, wave impedance exists between the electric field and the magnetic field in an electromagnetic wave. Partial reflection and partial transmission occur in a boundary in the transmission line where the characteristic impedance changes. Likewise, some of electromagnetic waves undergo reflection at a boundary where the wave impedance changes, and others pass through the boundary.

A loss of the electromagnetic wave caused by the electromagnetic shield layer 27 formed from metallic foil and a loss of the electromagnetic wave caused by the additional electromagnetic shield layers 33 formed from metallic foil become equal to an aggregate of various losses. A total loss is a sum of a reflection loss, an absorption loss, and a correction of re-reflection.

In the flat shielded electric wire 11 of the embodiment, each of regions of high current density which would deteriorate a shielding characteristic; namely, each of the long sides 13, is provided with an electromagnetic shield structure that exhibits high shielding performance.

Specifically, in the flat shielded electric wire 11, the additional electromagnetic shield layers 33 are provided solely for the long sides 13. Accordingly, when compared with the case where an entire outer circumference of the electromagnetic shield layer 27 is provided with the additional electromagnetic shield layer 33, the mass and material costs of the shielded electric wire can be reduced. By means of actual measurement and simulations, it could be ascertained that an increase occurred in total loss of the electromagnetic wave caused at the long sides 13 even in the case of the flat shielded electric wire 11 in which the additional electromagnetic shield layers 33 were provided solely for the long sides 13 and that there could be exhibited a shielding characteristic equivalent to that achieved in the case of the flat shielded electric wire including the additional electromagnetic shield layers 33 laid along the entire outer circumference of the electromagnetic shield layer 27.

Accordingly, the flat shielded electric wire 11 of the embodiment prevents deterioration of the shielding characteristic with reduction of material costs and mass of the shielded electric wire.

A shielded electric wire of a second embodiment of the invention is now described.

Figure 2:
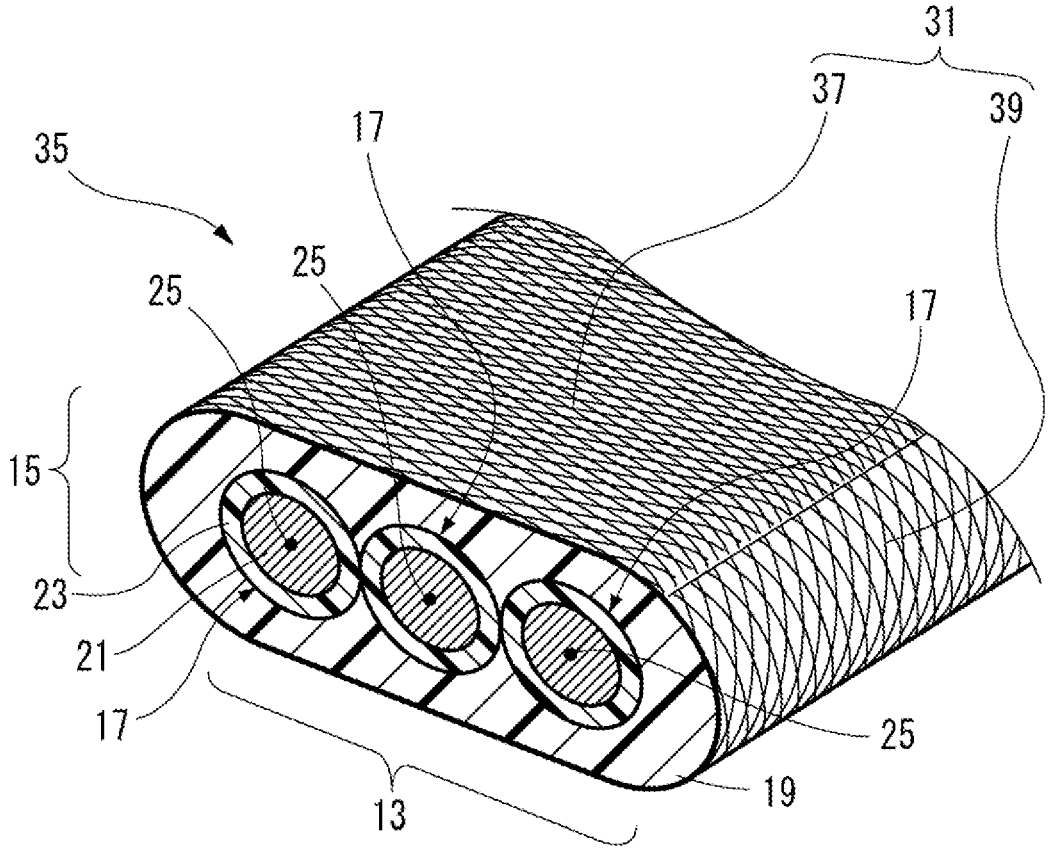
FIG. 2 is a transverse cross sectional view of a shielded electric wire of a second embodiment of the invention.
Figure 3A:
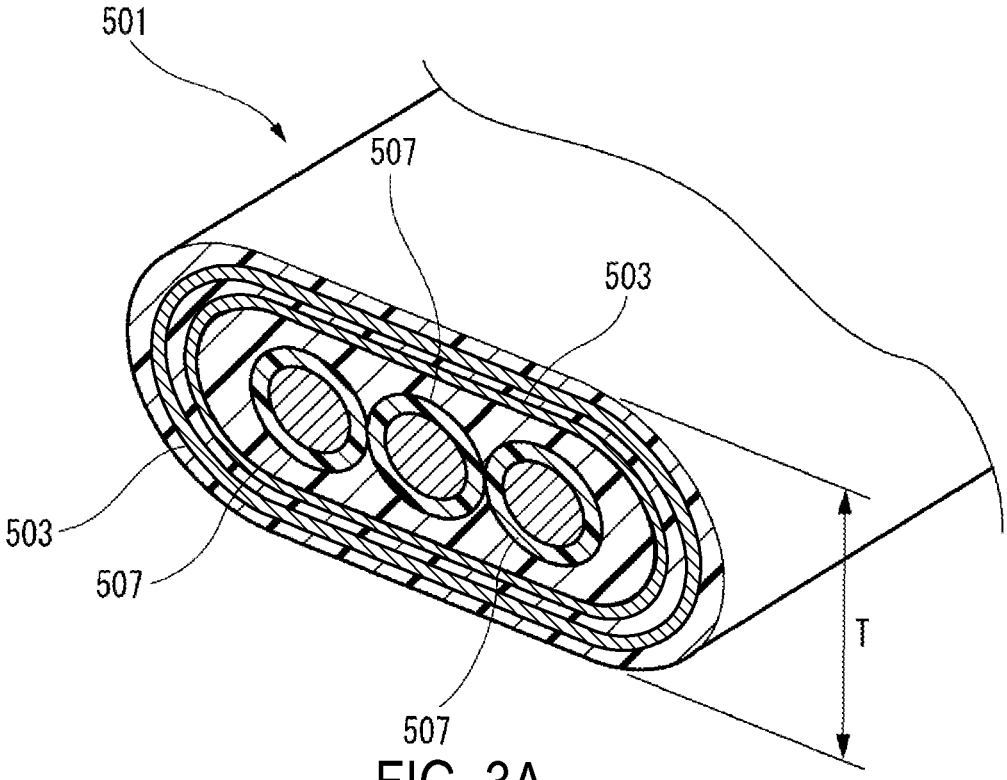
FIG. 3A RELATED ART
FIG. 3A is a transverse cross sectional view of a related art flat shielded electric wire assuming a horizontally long, flat cross sectional wire profile.
Figure 3B:
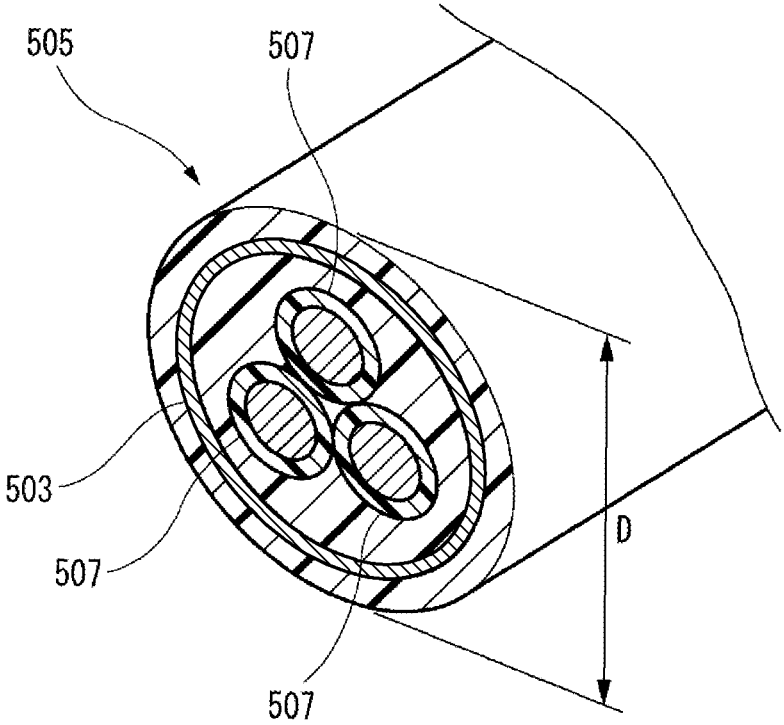
FIG. 3B RELATED ART
FIG. 3B is a transverse cross sectional view of a related art shielded electric wire including three core wires arranged in a triangular layout.

FIG. 2 is a transverse cross sectional view of a flat shielded electric wire 35 of a second embodiment of the invention. Members that are equal to their counterparts of the flat shielded electric wire 11 of the first embodiment shown in FIG. 1 are assigned the same reference numerals, and their repeated explanations are omitted.

As shown in FIG. 2, the flat shielded electric wire 35 of the second embodiment is a shielded electric wire having the plurality of sheathed core wires 17 whose core centers 25 are laid side by side at grade. The flat shielded electric wire 35 assumes a horizontally long flat cross sectional wire profile; has an electromagnetic shielding structure made up of the pair of mutually-opposed long sides 13 laid in line with the direction in which the sheathed core wires 17 are arranged in the wire cross section and another different electromagnetic shielding structure made up of the pair of mutually-opposed short sides 15; and is configured such that the long sides 13 exhibit a higher shielding effect than that yielded by the short sides 15.

Specifically, the flat shielded electric wire 35 of the embodiment has the sheathed core wires 17, the insulating layer 19, and an electromagnetic shield layer 31 enclosing all of the sheathed core wires 17 arranged side by side. Moreover, the electromagnetic shield layer 31 includes a pair of high density braided shields 37 laid along the pair of mutually-opposed long sides 13 laid in line with the direction in which the sheathed core wires 17 are arranged side by side in the wire cross section and a pair of low density braided shields 39 connecting together both ends of the high density braided shields 37. Gradations may exist in a boundary between the high density braided shields 37 and the low density braided shields 39.

Specifically, an outer circumference of the insulating layer 19 that covers the three sheathed core wires 17 and that assumes an elliptical cross sectional profile is covered with the electromagnetic shield layer 31. A metal braid can be used for the electromagnetic shield layer 31. A tinned soft copper wire, or the like, which has an element wire diameter of 0.10 to millimeters, is used for the metal braid, and the element wires are braided at a predetermined braid angle.

A density difference existing between the high density braided shields 37 laid along the long sides 13 and the low density braided shields 39 laid along the short sides 15 can be imparted by; for instance, an element wire diameter difference, a pitch difference, and a braid angle difference. Accordingly, the low density braided shields 39 can be made lighter than the high density braided shields 37 in terms of mass per unit area.

Operation of the flat shielded electric wire 35 having the foregoing configuration is now described.

Even in the flat shielded electric wire 35 of the embodiment, each of regions of high current density which would deteriorate a shielding characteristic; namely, each of the long sides 13, is provided with the high density braided shield 37 that exhibits high shielding performance.

Specifically, in the flat shielded electric wire 35, the high density braided shields 37 are provided for the respective long sides 13, whilst the low density braided shields 39 are provided for the respective short sides 15. Accordingly, when compared with the case where an entire outer circumference of the insulating layer 19 is provided with the high density braided shield 37, the mass and material costs of the shielded electric wire can be reduced. Further, by means of actual measurement and simulations, it could be ascertained that an increase occurred in total loss of the electromagnetic wave originating from the long sides 13 even in the case of the flat shielded electric wire 35 in which the long sides 13 are provided with the high density braided shields 37 and in which the short sides 15 are provided with the low density braided shields 39. It could also be ascertained that there could be exhibited a shielding characteristic equivalent to that yielded by the flat shielded electric wire including the high density braided shield 37 laid along the entire outer circumference of the insulating layer 19.

Accordingly, the flat shielded electric wire 35 of the embodiment prevents deterioration of the shielding characteristic with reduction of material costs and mass of the shielded electric wire.

It is apparent that various modifications can be made in the invention within a scope not deviating from the gist of the invention.

The present application is based on Japanese patent application No. 2011-241336 filed on Nov. 2, 2011, and the contents of the patent application are incorporated herein by reference.

INDUSTRIAL APPLICABILITY

The present invention is useful for providing a shielded electric wire that prevents deterioration of a shielding characteristic while preventing an increase in mass and material cost even when the electric wire assumes a horizontally long cross sectional wire profile.

What is claimed is:

1. A shielded electric wire having a plurality of sheathed core wires whose core centers are positioned side by side at grade, the shielded electric wire comprising:

an electromagnetic shield layer enclosing all of the positioned sheathed core wires and a pair of additional electromagnetic shield layers laid along a pair of mutually-opposed long sides in line with a direction in which the sheathed core wires are arranged in a wire cross section, wherein the electromagnetic shield layer is separated from each one of the pair of additional electromagnetic shield layers by an insulating layer.

2. A shielded electric wire having a plurality of sheathed core wires whose core centers are positioned side by side at grade, wherein an electromagnetic shield layer enclosing all of the positioned sheathed core wires includes a pair of high density braided shields provided along a pair of mutually-opposed long sides in line with a direction in which the sheathed core wires are arranged in a wire cross section and a pair of low density braided shields for connecting together both side ends of the high density braided shields.

* * * * *